United States Patent [19]

Bass et al.

[11] Patent Number: 4,559,533

[45] Date of Patent: Dec. 17, 1985

[54] METHOD OF ELECTRONICALLY MOVING PORTIONS OF SEVERAL DIFFERENT IMAGES ON A CRT SCREEN

[75] Inventors: Leland J. Bass; Roy F. Quick, Jr., both of San Diego; Ashwin V. Shah, Encinitas; Ralph O. Wickwire, San Diego, all of Calif.

[73] Assignee: Burroughs Corporation, Detroit, Mich.

[21] Appl. No.: 548,551

[22] Filed: Nov. 3, 1983

[51] Int. Cl.[4] ..... G09G 1/00

[52] U.S. Cl. ..... 340/724; 340/721; 340/747; 340/750

[58] Field of Search ..... 340/724, 747, 748, 750, 340/721

[56] References Cited

U.S. PATENT DOCUMENTS

| | | | |
|---|---|---|---|
| 4,197,590 | 4/1980 | Sukonick et al. | 340/731 X |
| 4,200,869 | 4/1980 | Murayama et al. | 340/709 X |
| 4,414,628 | 11/1983 | Ahuja et al. | 340/721 X |
| 4,439,760 | 3/1984 | Fleming | 340/747 X |
| 4,470,042 | 9/1984 | Barnicia et al. | 340/721 X |
| 4,484,187 | 11/1984 | Brown et al. | 340/721 X |

*Primary Examiner*—Gerald L. Bribance
*Assistant Examiner*—Vincent P. Kovalick
*Attorney, Agent, or Firm*—Charles J. Fassbender; Kevin R. Peterson

[57] ABSTRACT

A method of electronically moving portions of several different images on a CRT screen includes the steps of: storing a first image in one section of an image memory, and storing a second image in a different section of the image memory; storing control bits in a control memory which define high and low priority viewports on the screen and correlate portions of the first and second images to the high and low priority viewports respectively; displaying, in response to the stored control bits, the entire portion of the image in the high priority viewport and only the non-overlapping portion of the image in the low priority viewport by transferring the image portions from the image memory to the screen with no frame buffer therebetween; modifying at least some of the stored control bits to change the priorities of the high and low priority viewports to low and high respectively; and repeating the displaying step, in response to the modified control bits, to display the entire portion of the image in the new high priority viewport and only the non-overlapping portion of the image in the new low priority viewport.

10 Claims, 21 Drawing Figures

| | 0 | 1 | 2 | 3 | 4 | • • • • | 18 | 19 | X | X | X | X | X |
|---|---|---|---|---|---|---|---|---|---|---|---|---|---|
| UNIT 15 FORMS ADDRESS | | | | | | | | | | | | | |
| BUS 13 SENDS ADDRESS | X | 0 | 1 | 2 | 3 | 4 | • • • • | 18 | 19 | X | X | X | X |
| MEMORY 14 SENDS PIXAL WD | X | X | 0 | 1 | 2 | 3 | 4 | • • • • | 18 | 19 | X | X | X |
| SHIFTER 49 SHIFTS PIXALS | X | X | X | 0 | 1 | 2 | 3 | 4 | • • • • | 18 | 19 | X | X |
| | T0 | T1 | T2 | T3 | T4 | | | | | T21 | T22 | | |

16
V2
V7
V1
V2'
V1'
V7'
V2"
V1"
V7"
BLOCK #
#0
#1
#299
VIEWPORT #
1 2 3 4 5 6 7
32
BP#1
BP#2
BP#7
42
IWR
CLAR
ILAR
#1
#2
#3
#4
#5
#6
#7

METHOD OF ELECTRONICALLY MOVING PORTIONS OF SEVERAL DIFFERENT IMAGES ON A CRT SCREEN

BACKGROUND OF THE INVENTION

This invention relates to the architecture of electronic graphics systems for displaying portions of multiple images on a CRT screen.

In general, to display an image on a CRT screen, a focused beam of electrons is moved across the screen in a raster scan type fashion; and the magnitude of the beam at any particular point on the screen determines the intensity of the light that is emitted from the screen at that point. Thus, an image is produced on the screen by modulating the magnitude of the electron beam in accordance with the image as the beam scans across the screen.

Similarly, to produce a color image on a CRT screen, three different beams scan across the screen in very close proximity to each other. However, those three beams are respectively focused on different color-emitting elements on the screen (such as red, green, and blue color-emitting elements); and so the composite color that is emitted at any particular point on the screen is proportional to the magnitude of the three electron beams at that point.

Also, in a digital color system, the intensity and/or color of the light that is to be emitted at any particular point on the CRT screen is encoded into a number of bits that is called the pixel. Suitably, six bits can encode the intensity of light at a particular point on a black and white screen; whereas eighteen bits can encode the color of light that is to be emitted at any particular point on a color screen.

Typically, the total number of points at which light is emitted on a CRT screen (i.e., the total number of light-emitting points in one frame) generally is quite large. For example, a picture on a typical TV screen consists of 480 horizontal lines; and each line consists of 640 pixels. Thus, at six bits per pixel, a black and white picture consists of 1,843,200 bits; and at eighteen bits per pixel, a color picture consists of 5,529,600 bits.

In prior art graphics systems, a frame buffer was provided which stored the pixels for one frame on the screen. Those pixels were stored at consecutive addresses in the sequence at which they were needed to modulate the electron beam as it moved in its raster-scanning pattern across the screen. Thus, the pixels could readily be read from the frame buffer to form a picture on the CRT screen.

However, a problem with such a system is that it takes too long to change the picture that is being displayed via the frame buffer. This is because 1.8 million bits must be written into the frame buffer in order to change a black and white picture; and 5.5 million bits must be written into the frame buffer to change a color picture. This number of bits is so large that many seconds pass between the time that a command is given to change the picture and the time that the picture actually changes. And typically, a graphics system operator cannot proceed with his task until the picture changes.

Also in a graphics system, the picture that is displayed on the screen typically is comprised of various portions of several different images. In that case, it often is desirable to display the various image portions with different degrees of prominence.

For example, it is desirable for each of the image portions to be displayed in its own independent set of colors and/or be displayed with different blink rates. However, this is not possible with the above-described prior art graphics system since there is no indication in a frame buffer of which image a particular pixel is part of.

Accordingly, a primary object of the invention is to provide an improved graphics system for electronically displaying multiple images on a CRT screen.

BRIEF SUMMARY OF THE INVENTION

This object and others are achieved in accordance with the invention by a method of electronically moving portions of several different images on a CRT screen, including the steps of: storing a first image in one section of an image memory, and storing a second image in a different section of the image memory; storing control bits in a control memory which define high and low priority viewports on the screen and correlate portions of the first and second images to the high and low priority viewports respectively; displaying, in response to the stored control bits, the entire portion of the image in the high priority viewport and only the non-overlapping portion of the image in the low priority viewport by transferring the image portions from the image memory to the screen with no frame buffer therebetween; modifying at least some of the stored control bits to change the priorities of the high and low priority viewports to low and high respectively; and repeating the displaying step, in response to the modified control bits, to display the entire portion of the image in the new high priority viewport and only the non-overlapping portion of the image in the new low priority viewport.

BRIEF DESCRIPTION OF THE DRAWINGS

Various features and advantages of the invention are described in the Detailed Description in accordance with the accompanying drawings wherein.

DETAILED DESCRIPTION OF THE INVENTION

Figure 1:
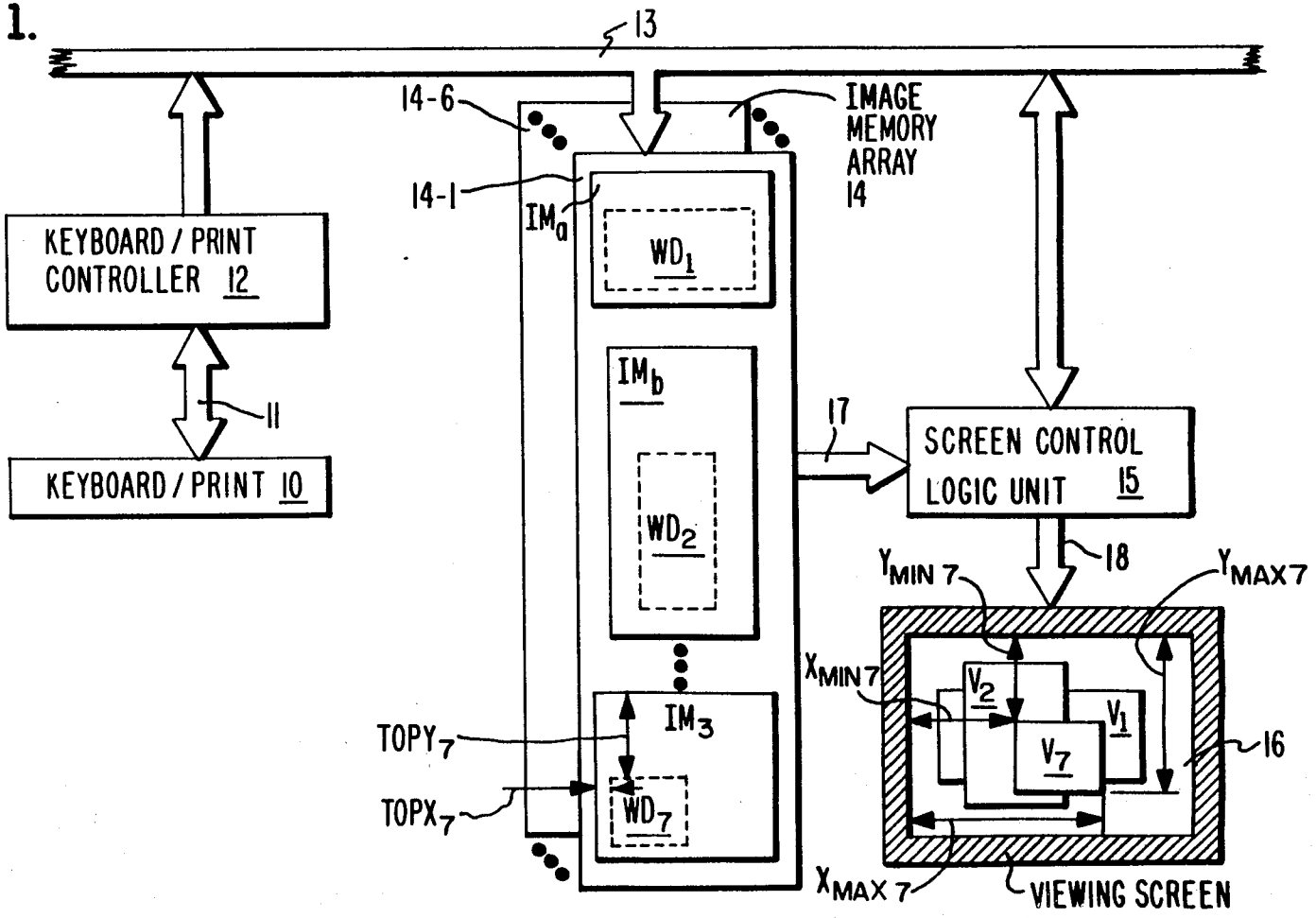
FIG. 1 illustrates one preferred embodiment of the invention.

Referring now to FIG. 1, a block diagram of the disclosed visual display system will be described. This system includes a keyboard/printer 10 which is coupled via a bus 11 to a keyboard/printer controller 12. In operation, various commands which will be described in detail later are manually entered via the keyboard; and those commands are sent over bus 11 where they are interpreted by the controller 12.

Controller 12 is coupled via another bus 13 to a memory array 14 and to a screen control logic unit 15. In operation, various images are specified by commands from keyboard 10; and those images are loaded by controller 12 over bus 13 into memory array 14. Also, various control information is specified by commands from keyboard 10; and that information is sent from controller 12 over bus 13 to the screen control logic unit 15.

Memory array 14 is comprised of six memories 14-1 through 14-6. These memories 14-1 through 14-6 are logically arranged as planes that are stacked behind one another. Each of the memory planes 14-1 through 14-6 consists of 64K words of 32 bits per word.

Bus 13 includes 32 data lines and 16 word address lines. Also, bus 13 includes a read/write line and six enable lines which respectively enable the six memories 14-1 through 14-6. Thus, one word of information can be written from bus 13 into any one of the memories at any particular word address.

Some of the images which are stored in memory array 14 are indicated in FIG. 1 as $IM_a$, $IM_b$, . . . $IM_z$. Each of those images consists of a set of pixels which are stored at contiguously addressed memory words. Each pixel consists of six bits of information which define the intensity of a single dot on a viewing screen 16. For any particular pixel, memory 14-1 stores one of the pixel bits; memory 14-2 stores another pixel bit; etc.

Figure 7:
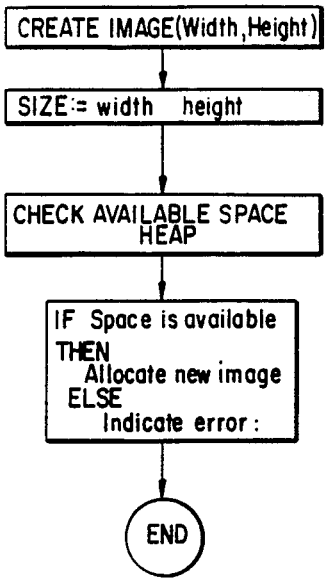
FIG. 7 is a flow chart illustrating the Create Image Command.

To form an image in memory array 14, a CREATE IMAGE command (FIG. 7) is entered via keyboard 10. Along with this command, the width and height (in terms of pixels) of the image that is to be created are also entered. In response thereto, controller 12 allocates an area in memory array 14 for the newly created image.

In performing this allocation task, controller 12 assigns a beginning address in memory array 14 for the image; and it reserves a memory space following that beginning address equal to the specified pixel height times the specified pixel width. Also, controller 12 assigns an identification number to the image and prints that number via the printer 10.

Figure 8:
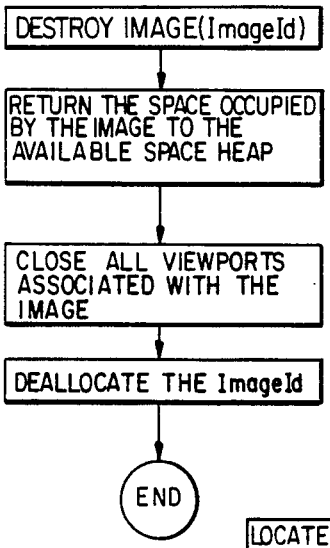
FIG. 8 is a flow chart illustrating the Destroy Image Command.

Conversely, to remove an image from memory array 14, a DESTROY IMAGE command (FIG. 8) is entered via keyboard 10. The identification number of the image that is to be destroyed is also entered along with this command. In response thereto, controller 12 deallocates the space in memory array 14 that it had previously reserved for the identified image area.

Actual bit patterns for the pixels of an image are entered into memory array 14 via a MOVE ABS command and a LINE ABS command. Along with the MOVE ABS command, the keyboard operator also enters the image ID and the $X_1Y_1$ coordinates in pixels of where a line is to start in the image. Similarly, along with the LINE ABS command, the keyboard operator enters the image ID and $X_2Y_2$ coordinates in pixels of where a line is to end in the image.

In response thereto, controller 12 sends pixels over bus 13 to memory 14 which define a line in the identified image from $X_1Y_1$ to $X_2Y_2$. These pixels are stored in memory 14 such that the pixel corresponding to the top left corner of an image is stored at the beginning address of that image's memory space; and pixels following that address are stored using a left-to-right and top-to-bottom scan across the image. To remove an image from memory 14, a DESTROY IMAGE command is simply entered via keyboard 10 along with the image's ID.

After the images have been created in memory array 14, the screen control logic unit 15 operates to display various portions of those images on a viewing screen 16. To that end, logic unit 15 sends a word address over bus 13 to the memory array 14; and it also activates the read line and six enable lines.

In response, logic unit 15 receives six words from array 14 over a bus 17. Bus 17 includes $32\times6$ data output lines. One of the received words comes from memory 14-1; another word comes from memory 14-2; etc. These six words make up one word of pixels.

Upon receiving the addressed word of pixels, unit 15 sends them one pixel at a time over a bus 18 to the viewing screen 16. Then, the above sequence repeats over and over again. Additional details of this sequence will be described in conjunction with FIG. 2.

However, before any image can be displayed, a viewport must be located on the viewing screen 16. In FIG. 1, three such viewports are indicated as $V_1$, $V_2$, and $V_7$. These viewports are defined by entering a LOCATE VIEWPORT command via keyboard 10 to logic unit 12.

Figure 9:
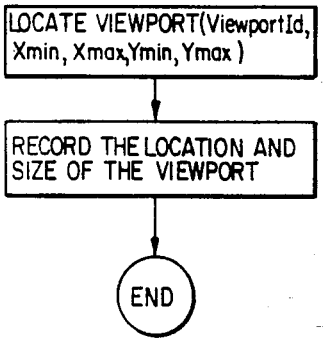
FIG. 9 is a flow chart illustrating the Locate Viewpoint Command.

Along with the LOCATE VIEWPORT command (FIG. 9), four parameters $X_{min}$, $X_{max}$, $Y_{min}$, and $Y_{max}$ are also entered. Screen 16 is divided into a grid of 20 blocks in a horizontal direction and 15 blocks in the vertical direction for a total of 300 blocks. Each block is $32\times32$ pixels. And the above parameters define the viewport on screen 16 in terms of these blocks.

For example, setting the parameters $X_{min}$, $X_{max}$, $Y_{min}$, and $Y_{max}$ equal to (1, 10, 1, 10) locates a viewport on screen 16 which occupies 10 blocks in each direction and is positioned in the upper left corner of screen 16. Similarly, setting the parameters equal to (15, 20, 1, 10) locates a viewport on screen 16 which is $5\times10$ blocks in the upper right corner of the screen.

A viewport identification/priority number is also entered via keyboard 10 along with each LOCATE VIEWPORT command. This number can range from 1 to 7; and number 7 has the highest priority. As illustrated in FIG. 1, the viewports can be located such that they overlap. But only the one viewport which has the highest priority number at a particular overlapping block will determine which image is there displayed.

Figure 10:
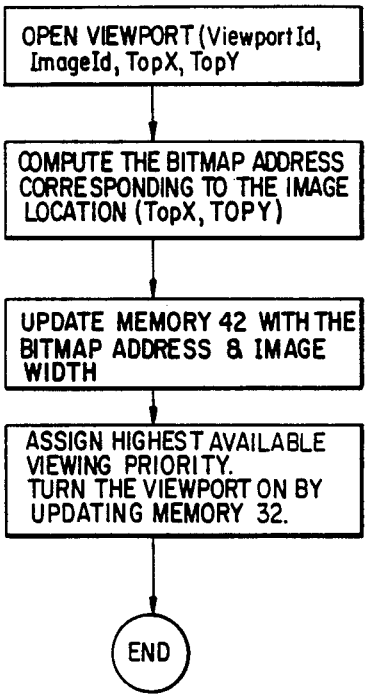
FIG. 10 is a flow chart illustrating the Open Viewpoint Command.
Figure 11:
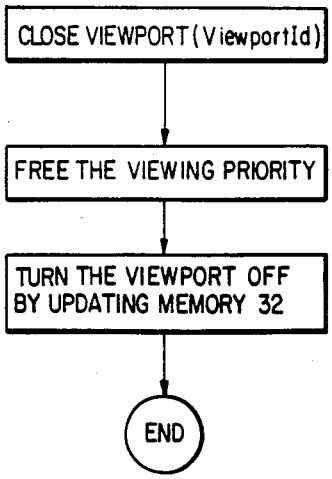
FIG. 11 is a flow chart illustrating the Close Viewpoint Command.
Figure 12:
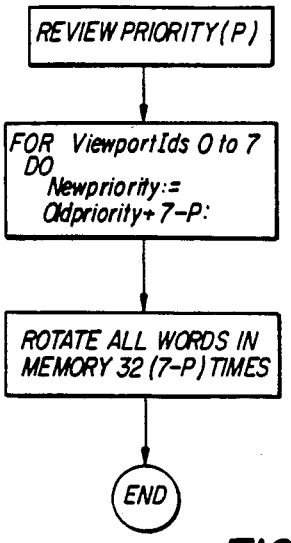
FIG. 12 is a flow chart illustrating the Review Priority Command.
Figure 13:
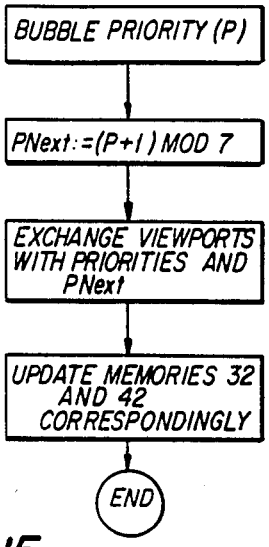
FIG. 13 is a flow chart illustrating the Bubble Priority Command.
Figure 14:
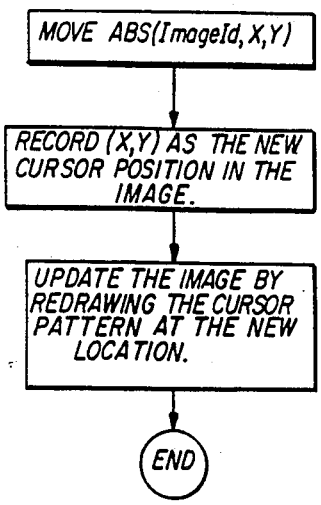
FIG. 14 is a flow chart illustrating the Move ABS Command.
Figure 15:
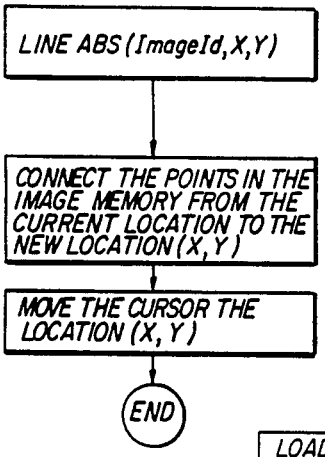
FIG. 15 is a flow chart illustrating the Line ABS Command.

After a viewport has been located, an OPEN VIEWPORT command (FIG. 10) must be entered via keyboard 10 to display a portion of an image through the viewport. Other parameters that are entered along with this command include the identification number of the viewport that is to be opened, the identification number of the image that is to be seen through the opened viewport, and the location in the image where the upper left-hand corner of the opened viewport is to lie. These location parameters are given in pixels relative to the top left-hand corner of the image itself; and they are called TOPX and TOPY.

That portion of an image which is matched with a viewport is called a window. In FIG. 1, the symbol $WD_1$ indicates an example of a window in image $IM_a$ that matches with viewport $V_1$. Similarly, the symbol $WD_2$ indicates a window in image $IM_b$ that matches with viewport $V_2$; and the symbol $WD_7$ indicates a window in image $IM_z$ that matches with viewport $V_7$.

Figure 2:
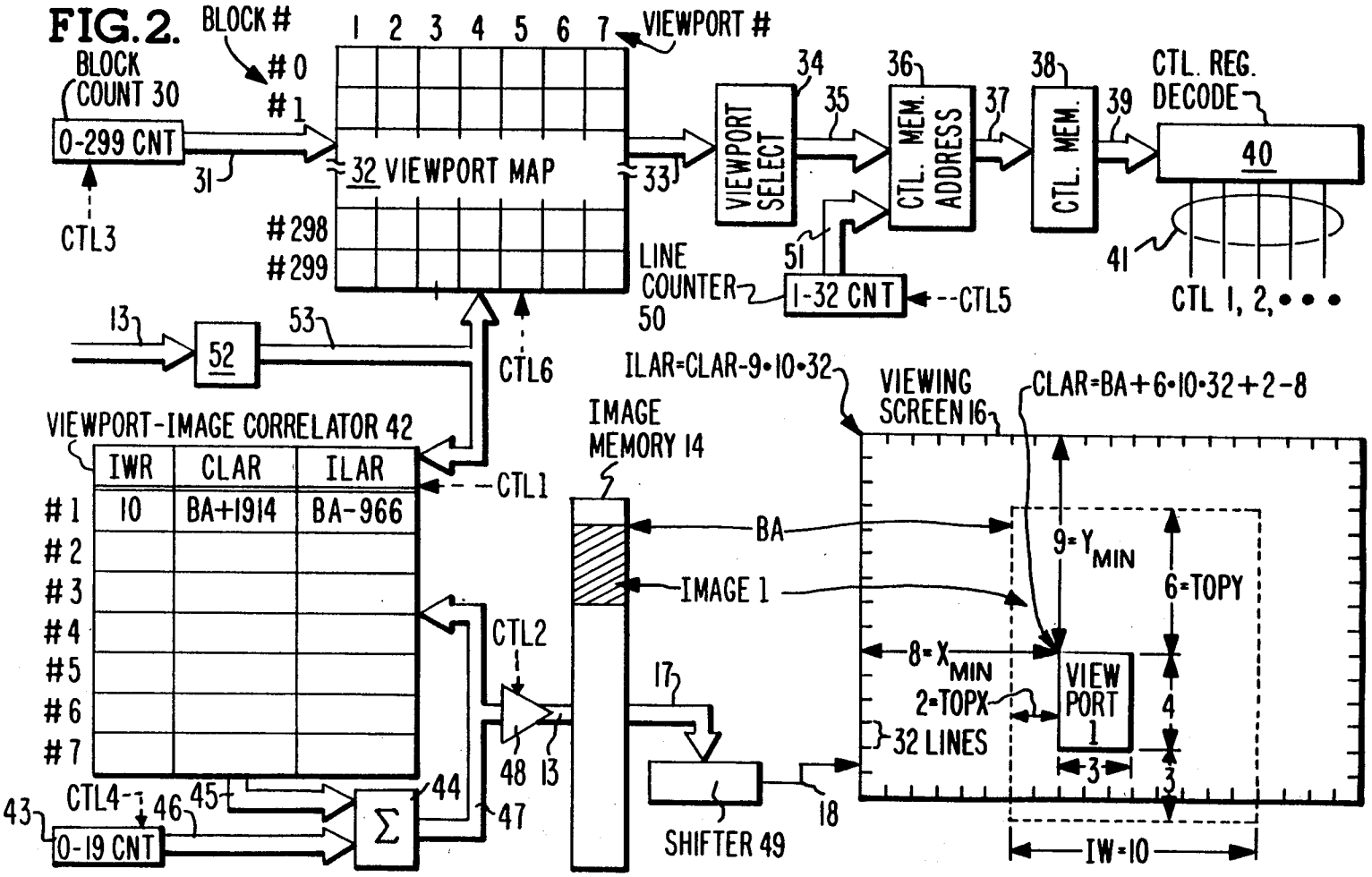
FIG. 2 illustrates additional details of a screen control logic unit in FIG. 1.

Consider now, in greater detail, the exact manner by which the screen control logic unit 15 operates to retrieve pixel words from the various images in memory 14. This operation and the circuitry for performing the same is illustrated in FIG. 2. All of the components 30 through 51 which are there illustrated are contained within logic unit 15.

These components include a counter 30 which stores the number of a block in the viewing screen for which pixel data from memory array 14 is sought. Counter 30 counts from 0 to 299. When the count is 0, pixel data for the leftmost block in the upper row of the viewing screen is sought; when the count is 1, pixel data for the next adjacent block in the upper row of the viewing screen is sought; etc.

Counter 30 is coupled via conductors 31 to the address input terminals of a viewport map memory 32. Memory 32 contains 300 words; and each word contains seven bits. Word 0 corresponds to block 0 on screen 16; word 1 corresponds to block 1; etc. Also, the seven bits in each word respectively correspond to the previously described seven viewports on screen 16.

If bit 1 for word 0 in memory 32 is a logical 1, then viewport 1 includes block 0 and viewport 1 is open. Conversely, if bit 1 for word 0 is a logical 0, then viewport 1 either excludes block 0 or viewport 1 is closed.

All of the other bits in memory 32 are interpreted in a similar fashion. For example, if bit 2 of word 50 in memory 32 is a logical 1, then viewport 2 includes block 50 and is open. Or, if bit 7 of word 60 in memory 32 is a logical 0, then viewport 7 either excludes block 60 or the viewport is closed.

Each word that is addressed in memory 32 is sent via conductors 33 to a viewport selector 34. Selector 34 operates on the 7-bit word that it receives to generate a 3-bit binary code on conductors 35; and that code indicates which of the open viewports have the highest priority. For example, suppose counter 30 addresses word 0 in memory 32; and bits 2 and 6 of word 0 are a logical 1. Under those conditions, selector 34 would generate a binary 6 on the conductors 35.

Signals on the conductors 35 are sent to a circuit 36 where they are concatenated with other signals to form a control memory address on conductors 37. If viewport 1 is the highest priority open viewport, then a first control memory address is generated on conductors 37; if viewport 2 is the highest priority open viewport, then another control memory address is generated on the conductors 37, etc.

Addresses on the conductors 37 are sent to the address input terminals of a control memory 38; and in response thereto, control memory 38 generates control words on conductors 39. From there, the control words are loaded into a control register 40 whereupon they are decoded and sent over conductors 41 as control signals CTL1, CTL2, . . .

Signals CTL1 are sent to a viewport-image correlator 42 which includes three sets of seven registers. The first set of seven registers are identified as image width registers (IWR 1–IWR 7); the second set are identified as current line address registers (CLAR 1–CLAR 7); and the third set are identified as the initial line address registers (ILAR 1–ILAR 7).

Each of these registers is separately written into and read from in response to the control signals CTL1. Suitably, each of the IWR registers holds eight bits; and each of the CLAR and ILAR registers hold sixteen bits.

Register IWR 1 contains the width (in blocks) of the image that is viewed through viewport 1. Thus, if image 5 has a width of 10 blocks and that image is being viewed through viewport 1, then the number 10 is in register IWR 1. Similarly, register IWR 2 contains the width of the image that is viewed through viewport 2, etc.

Register CLAR 1 has a content which changes with each line of pixels on screen 15. But when the very first word of pixels in the upper left corner of viewport 1 is being addressed, the content of CLAR 1 can be expressed mathematically as $BA+(TOPY)(IW)(32)+TOPX-X_{min}$.

In this expression, BA is the base address in memory 14 of the image that is being displayed in viewport 1. TOPX and TOPY give the position (in blocks) of the top left corner of viewport 1 relative to the top left corner of the image that it is displaying. IW is the width (in blocks) of viewport 1 relative to the image that it is displaying. And $X_{min}$ is the horizontal position (in blocks) of viewport 1 relative to screen 16.

An example of each of these parameters is illustrated in the lower right-hand portion of FIG. 2. There, viewport 1 is displaying a portion of image 1. In this example, the parameter TOPX is 2 blocks; the parameter TOPY is 6 blocks; the parameter IW is 10 blocks; and the parameter $X_{min}$ is 8 blocks. Thus, in this example, the entry in register CLAR 1 is $BA+1914$ when the upper left word of viewport 1 is being addressed.

Consider now the physical meaning of the above entry in register CLAR 1. BA is the beginning address of image 1; and the next term of $(6)(10)(32)+(2)$ is the offset (in words) from the base address to the word of image 1 that is being displayed in the upper left-hand corner of viewport 1.

That word in the upper left-hand corner of viewport 1 is (6)(10) blocks plus 2 words away from the word at the beginning address in image 1; and each of those blocks contains 32 lines. Therefore, the address of the word in the upper left-hand corner of viewport 1 is $BA+(6)(10)(32)+2$.

Note, however, that the term $X_{min}$ is subtracted from the address of the word in the upper left-hand corner of viewport 1 to obtain the entry in register CLAR 1. This subtraction occurs because logic unit 15 also includes a counter 43 which counts horizontal blocks 0 through 19 across the viewing screen. And the number in counter 43 is added via an adder circuit 44 to the content of register CLAR 1 to form the address of a word in memory array 14.

To perform this add, conductors 45 transmit the contents of register CLAR 1 to adder 44; and conductors 46 transmit the contents of counter 43 to adder 44. Then, output signals from adder 44 are sent over conductors 47 through a bus transmitter 48 to bus 13. Control signals CTL2 enable transmitter 48 to send signals on bus 13.

In response to the address on bus 13, memory 14 sends the addressed word of pixels on bus 17 to a shifter 49. Shifter 49 receives the pixel word in parallel; and then shifts the word pixel by pixel in a serial fashion over bus 18 to the screen 16. One pixel is shifted out to screen 16 every 40 nanoseconds.

As an example of the above, consider what happens when the block counter 30 addresses the block in the top left corner of viewport 1. That block is (9)(20)+8 or 188. Under such conditions, word 188 is read from memory 32. Suppose next that word 188 indicates that viewport 1 has the highest priority. In response, signals CTL1 from control register 40 will select register CLAR 1.

Then, the count of register CLAR 1 is added to the content of counter 43 (which would be number 8) to yield the address of BA+1922. That address is the location in memory array 14 of the word in image 1 that is at the upper left-hand corner of viewport 1.

To address the next word in the memory array 14, the counters 30 and 43 are both incremented by 1 in response to control signals CTL3 and CTL4 respectively; and the above sequence is repeated. Thus, counter 30 would contain a count of 73; word 73 in memory 32 could indicate that viewport 1 has the highest priority; control signals from register 40 would then read out contents of register CLAR 1; and adder 44 would add the number 9 from counter 43 to the content of register CLAR 1.

The above sequence continues until one complete line has been displayed on screen 16 (i.e., counter 43 contains a count of nineteen). Then, during the horizontal retrace time on screen 16, counter 43 is reset to zero; and the content of each of the CLAR registers is incremented by the content of its corresponding IWR register. For example, register CLAR 1 is incremented by 10. This incrementing is achieved by sending the IWR and CLAR registers through adder 44 in response to the CTL1 control signals.

Another counter 50 is also included in logic unit 15; and it counts the lines from one to thirty-two within the blocks. Counter 50 is coupled via conductors 51 to the control memory address logic 36 where its content is sensed during a retrace. If the count in counter 50 is less than thirty-two, then counter 30 is set back to the value it had at the start of the last line, and counter 50 is incremented by one.

But when counter 50 reaches a count of thirty-two, then the next line on screen 16 passes through a new set of blocks. So in that event during the retrace, counter 30 is incremented by one, and counter 50 is reset to one. All changes to the count in counter 50 occur in response to control signals CTL5.

After the retrace ends, a new forward horizontal scan across screen 16 begins. And during this new forward scan, 20 new words of pixels are read from memory array 14 in accordance with the updated contents of components 30, 42, 43 and 50.

Next, consider the content and operation of the initial line address registers ILAR 1 through ILAR 7. Those registers contain a number which can be expressed mathematically as $BA+(TOPY)(IW)(32)+(TOPX)-X_{min}-(Y_{min})(IW)(32)$. In this expression, the terms BA, TOPX, TOPY, IW and $X_{min}$ are as defined above; and the term $Y_{min}$ is the vertical position (in blocks) of the top of the viewport relative to screen 16.

At the start of a new frame, the contents of the registers ILAR 1 through ILAR 7 are respectively loaded into the registers CLAR 1 through CLAR 7. Also, the content of the counters 30 and 43 are reset to 0. Then, counters 30 and 43 sequentially count up to address various locations in the memory array 14 as described above.

Each time counter 43 reaches a count of 19 indicating the end of a line has been reached, the registers CLAR 1 through CLAR 7 are incremented by their corresponding IW registers. As a result, the term $-(Y_{min})(IW)(32)$ in any particular CLAR register will be completely cancelled to zero when the first word of the horizontal line that passes through the top of the viewport which corresponds to that CLAR register is addressed. For example, the term (9)(10)(32) will be completely cancelled out from register CLAR 1 when counter 30 first reaches a count of 180.

Consider now how control bits in viewport map 32 and viewport-image correlator 42 are initially loaded. Those bits are sent by keyboard/printer controller 12 over bus 13 to logic unit 15 in response to the LOCATE VIEWPORT and OPEN VIEWPORT commands. As previously stated, the LOCATE VIEWPORT command (FIG. 9) defines the location of a viewport on screen 16 in terms of the screen's 300 blocks; and the OPEN VIEWPORT command (FIG. 10) correlates a portion of an image in memory 14 with a particular viewport.

Whenever a LOCATE VIEWPORT command is entered via keyboard 10, controller 12 determines which of the bits in viewport map 32 must be set in order to define a viewport as specified by the command parameters $X_{min}$, $X_{max}$, $Y_{min}$, and $Y_{max}$. Similarly, whenever an OPEN VIEWPORT command is entered via keyboard 10, controller 12 determines what the content of registers IWR and ILAR should be from the parameters $X_{min}$, $Y_{min}$, TOPX, TOPY, and IW.

After controller 12 finishes the above calculations, it sends a multiword message M1 over bus 13 to a buffer 50 in the screen control logic unit 15; and this message indicates a new set of bits for one of the columns in viewport map 32 and the corresponding IWR and ILAR registers. From buffer 15, the new set of bits is sent over conductors 51 to viewport map 32 and the IWR and ILAR registers in response to control signals CTL1 and CTL6. This occurs during the horizontal retrace time on screen 16.

Suitably, one portion of this message is a three bit binary code that identifies one of the viewports; another portion is a three hundred bit pattern that defines the bits in map 32 for the identified viewport; and another portion is a twenty-four bit pattern that defines the content of the viewport's IWR and ILAR registers.

Figures 3, 5:
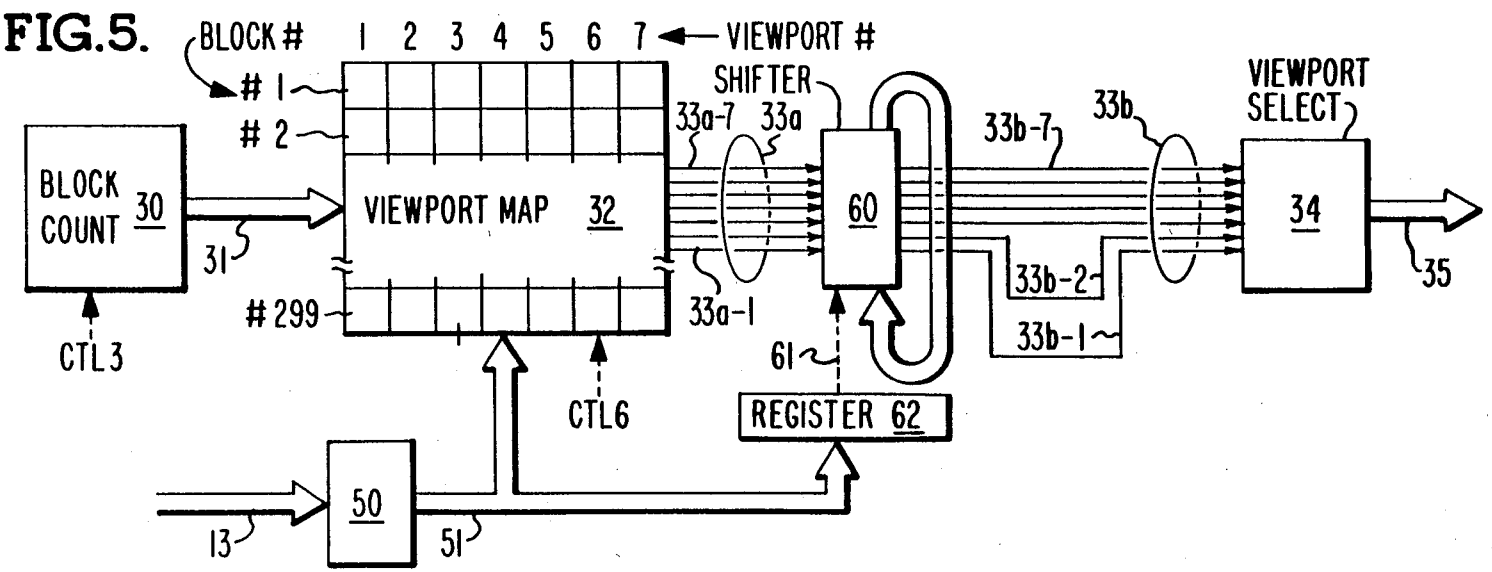
FIG. 3 illustrates a timing sequence by which the FIG. 1 system operates.
FIG. 5 illustrates a modification to the FIG. 2 screen control logic unit.

Turning now to FIG. 3, the timing by which the above operations are performed will be described. As FIG. 3 illustrates, the above operations are performed in a "pipelined" fashion. Screen control logic 15 forms one stage of the pipeline; bus 13 forms a second stage of the pipeline; memory 14 forms a third stage; and shifter 49 forms the last stage.

Each of the various pipeline stages perform their respective operations on different pixel words. For example, during time interval T0, unit 15 forms the address of the word that is to be displayed in block 0. Then, during time interval T1, unit 15 forms the address of the word that is to be displayed in block 1, while simultaneously, the previously formed address is sent on bus 13 to memory 14.

During the next time interval T2, unit 15 forms the address of the word of pixels that is to be displayed in block 2; bus 13 sends the address of the word that is to be displayed in block 1 to memory 14; and memory 14 sends the word of pixels that is to be displayed in block 0 to bus 17.

Then during the next time interval T3, unit 15 forms the address of the word of pixels that is to be displayed in block 3; bus 13 sends the address of the word that is to be displayed in block 2 to memory 14; memory 14 sends the word of pixels that is to be displayed in block 1 to bus 17; and shifter 49 serially shifts the pixels that are to be displayed in block 0 onto bus 18 to the screen.

The above sequence continues until time interval T22, at which time one complete line of pixels has been sent to the screen 16. Then a horizontal retrace occurs, and logic unit 15 is free to update the contents of the viewport map 32 and CLAR registers as was described above.

Pixels are serially shifted on bus 18 to screen 16 at a speed that is determined by the speed of the horizontal trace in a forward direction across screen 16. In one embodiment, a complete word of pixels is shifted to screen 16 every 1268 nanoseconds.

Preferably, each of the above-described pipelined stages perform their respective tasks within the time that one word of pixels is shifted to screen 16. This may be achieved, for example, by constructing each of the stages of high-speed Schottky $T^2L$ components.

Specifically, components 30, 32, 34, 36, 38, 40, 42, 43, 44, 48, 14, 49, 50 and 52 may respectively be 74163, 4801, 74148, 2910, 82S129, 74374, 74374, 74163, 74283, 74244, 4864, 74166, 74163 and 74373. Also, controller 12 may be a 8086 microprocessor that is programmed to send the above-defined messages to control unit 15 in response to the keyboard commands. A flow chart of one such program for all keyboard commands is attached at the end of this Detailed Description as an appendix.

Next, reference should be made to FIGS. 4A, 4B, and 4C in which the operation of a modified embodiment of the system of FIGS. 1–3 will be described. With this embodiment, the images that are displayed in the various viewports on screen 16 can be rearranged just like several sheets of paper in a stack can be rearranged. This occurs in response to a REVIEW VIEWPORT command which is entered via keyboard 10.

Figures 4A, 4B, 4C:
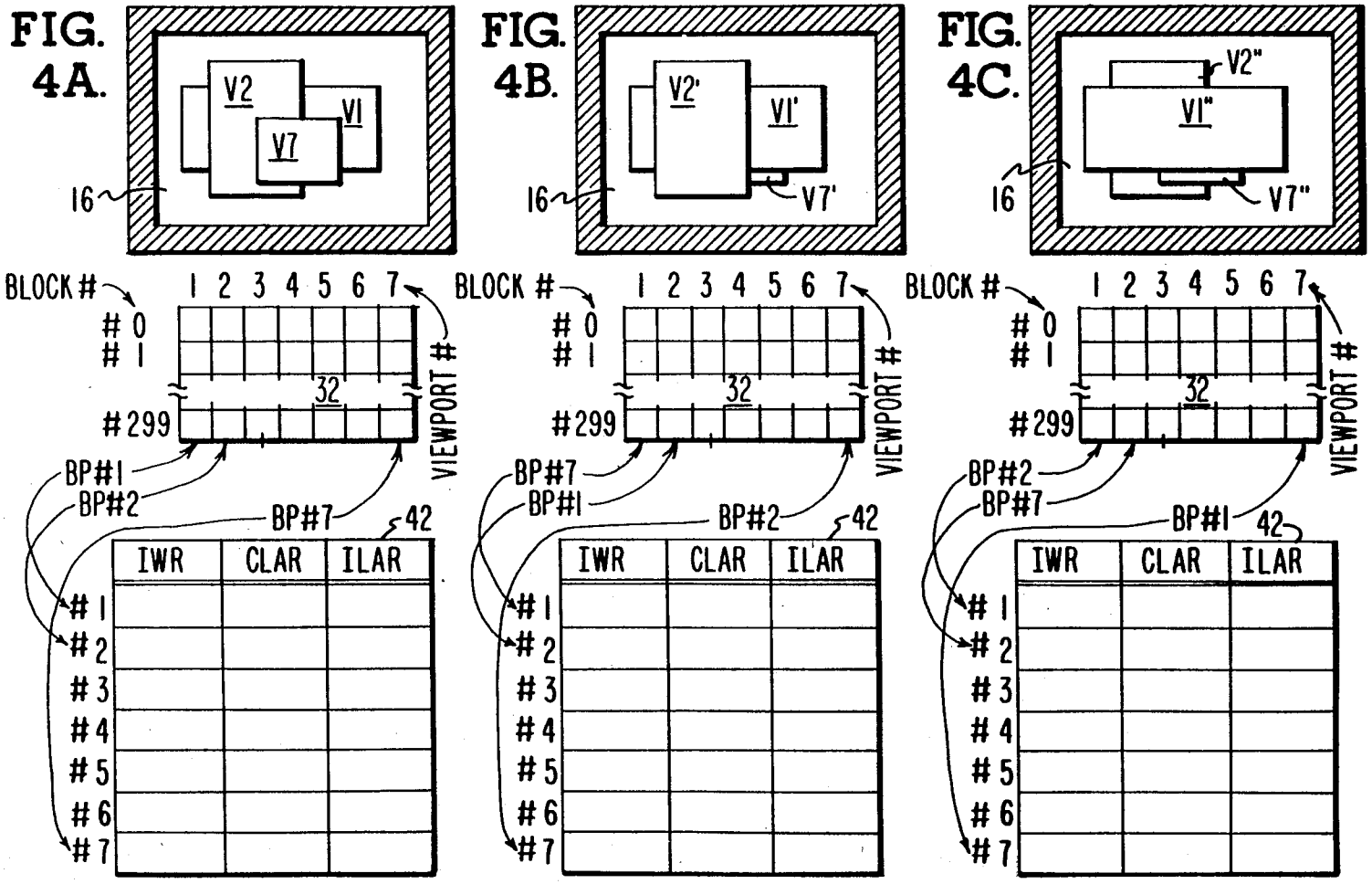
FIGS. 4A, 4B, and 4C illustrate the manner in which the FIG. 1 system moves several different images on a screen.

For example, FIG. 4A illustrates screen 16 having viewports V1, V2, and V7 defined thereon. Viewport 7 has the highest priority; viewport 2 has the middle priority; viewport 1 has the lowest priority; and each of the viewports display portions of respective images in accordance with their priority.

Next, FIG. 4B shows the viewports V1′. V2′, and V7, which show the same images as viewports V1, V2, and V7, but the relative priorities of the viewports on screen 16 have been changed. Specifically, viewport V2′ has the highest priority, viewport V1′ has the middle priority, and viewport V7′ has the lowest priority. This occurs in response to the REVIEW VIEWPORT command.

Similarly, in FIG. 4C, screen 16 contains viewports V1″, V2″, and V7″ which show the same images as viewports V1′, V2′, and V7′; but again the relative priorities of the viewports have again been changed by the REVIEW VIEWPORT command. Specifically, the priority order is first V1″, then V7″, and then V2″.

When the REVIEW VIEWPORT command is entered via keyboard 10, the number of the viewport that is to have the highest priority is also entered. Each of the other viewport priorities are then also changed according to expression: new priority=(old priority+6−priority of identified viewport) modulo 7.

Consider now how this REVIEW VIEWPORT command is implemented. To begin, assume that in order to define the viewports and their respective images and priorities as illustrated in screen 16 of FIG. 4A, the following control signals are stored in unit 15:

(a) Column 1 of map 32 together with registers IWR 1 and ILAR 1 contain a bit pattern which is herein identified as BP#1, (b) Column 2 of map 32 together with registers IWR 2 ILAR 2 contain a bit pattern which is herein identified as BP#2, and (c) Column 7 of map 32 together with registers IWR 7 and ILAR 7 contain a bit pattern which is herein identified as BP#7.

FIG. 4A illustrates that bit patterns BP#1, BP#2, and BP#7 are located as described in (a), (b), (c) above. By comparison, FIG. 4B illustrates where those same bit patterns are located in components 32 and 42 in order to rearrange viewports V1, V2, and V7 as viewports V2′, V1′, and V7′. Specifically, bit pattern BP#2 is moved to column 7 and its associated IWR and ILAR registers; bit pattern BP#1 is moved to column 2 and its associated IWR and ILAR registers; and bit pattern BP#7 is moved to column 1 and its associated IWR and ILAR registers.

In like manner, FIG. 4C illustrates where bit patterns BP#1, BP#2, and BP#7 are located in components 32 and 42 in order to rearrange viewports V1′, V2′, and V7′ as viewports V1″, V2″, and V7″. Specifically, bit pattern BP#1 is moved to column 7 in memory 32 and its associated registers; bit pattern BP#7 is moved to column 2 of memory 32 and its associated registers; and bit pattern BP#2 is moved to column 1 of memory 32 and its associated registers.

Suitably, this moving occurs in response to controller 12 sending three of the previously defined M1 messages on bus 13 to buffer 50. One such message can be handled by unit 15 during each horizontal retrace of screen 16. So the entire viewport rearranging operation that occurs from FIG. 4A to FIG. 4B, or from FIG. 4B to FIG. 4C, occurs within only three horizontal retrace times. Thus, to achieve this operation, no actual movement of the images in memory 14 occurs at all.

Turning now to FIG. 5, a modification to unit 15 will be described which enables the REVIEW VIEWPORT command to be implemented in an alternative fashion. This modification includes a shifter circuit 60 which is disposed between the viewport map memory 32 and the viewport select logic 34. Conductors **33*a* transmit the seven signals from memory 32 to input terminals on shifter 60; and conductors 33*b* transmit those same signals after they have been shifted to the input terminals of the viewport select logic 34**.

Shifter 60 has control leads 61; and it operates to shift the signals on the conductors **33*a* in an end-around fashion by a number of bit positions as specified by a like number on the leads 61. For example, if the signals on the leads 61 indicate the number of one, then the signals on conductors 33*a*-1 and 33*a*-7 are respectively transferred to conductors 33b-2 and 33b-1. Suitably, shifter 60** is comprised of several 74350 chips.

Also included in the FIG. 5 circuit is a register 62. It is coupled to buffer 50 to receive the 3-bit number that specifies the number of bit positions by which the viewport signals on the conductors 33a are to be shifted. From register 62, the 3-bit number is sent to the control leads 61 on shifter 60.

By this mechanism, the number of bits that must be sent over bus 13 to logic unit 15 in order to implement the REVIEW VIEWPORT command is substantially reduced. Specifically, all that needs to be sent is the 3-bit number for register 61. A microprogram in control memory 38 then operates to sense that number and swap the contents of the IWR and ILAR registers in accordance with that number. This swapping occurs by passing the contents of those registers through components 45, 44, and 47 in response to the CTL1 control signals.

Figure 6:
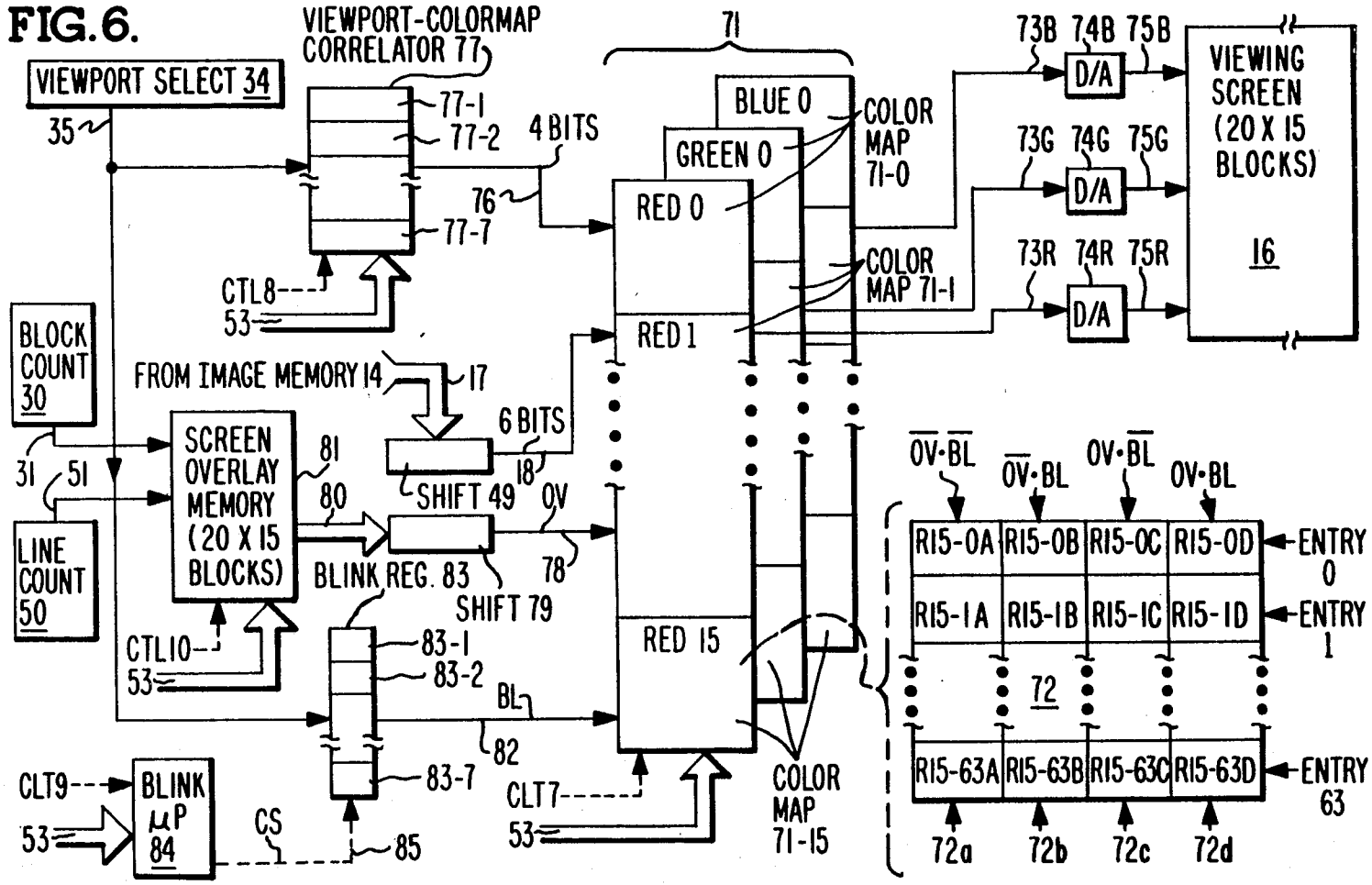
FIG. 6 illustrates still another modification to the FIG. 2 screen control logic unit.

Referring now to FIG. 6, still another modification to the FIG. 2 embodiment will be described. With this modification, each of the viewports on screen 16 has its own independent color map. In other words, each image that is displayed through its respective viewport has its own independent set of colors.

In addition, with this modification, each viewport on screen 16 can blink at its own independent rate. When an image blinks, it changes from one color to another in a repetitive fashion. Further, the duty cycle with which each viewport blinks is independently controlled.

Also with this modification, a screen overlay pattern is provided on screen 16. This screen overlay pattern may have any shape (such as a cursor) and it can move independent of the viewport boundaries.

Consider now the details of the circuitry that makes up the FIG. 6 modification. It includes a memory array 71 which contains sixteen color maps. In FIG. 6, individual color maps are indicated by reference numerals 71-0 through 71-15.

Each of the color maps has a red color section, a green color section, and a blue color section. In FIG. 6, the red color section of color map 71-0 is labeled "RED 0"; the green color section of color map 71-0 is labeled "GREEN 0"; etc.

Also, each color section of color maps 71-0 through 71-15 contains 64 entries; and each entry contains two pairs of color signals. This is indicated in FIG. 6 for the red color section of color map 71-15 by reference numeral 72. There the 64 entries are labeled "ENTRY 0" through "ENTRY 63"; one pair of color signals is in columns 72a and 72b; and another pair of color signals is in columns 72c and 72d.

Each of the entries 0 through 63 of color section 72 contains two pairs of red colors. For example, one pair of red colors in ENTRY 0 is identified as R15-0A and R15-0B wherein the letter R indicates red, the number 15 indicates the fifteenth color map, and the number 0 indicates entry 0. The other pair of red colors in ENTRY 0 is identified as R15-0C and R15-0D. Suitably, each of those red colors is specified by a six bit number.

Red colors from the red color sections are sent on conductors 73R to a digital-to-analog converter 74R whereupon the corresponding analog signals are sent on conductors 75R to screen 16. Similarly, green colors are sent to screen 16 via conductors 73G, D/A converter 74G, and conductors 75G; while blue colors are sent to screen 16 via conductors 73B, D/A converter 74B, and conductors 75B.

Consider now the manner in which the various colors in array 71 are selectively addressed. Four address bits for the array are sent on conductors 76 by a viewport-color map correlator 77. Correlator 77 also has input terminals which are coupled via conductors 35 to the previously described module 34 to thereby receive the number of the highest priority viewport in a particular block.

Correlator 77 contains seven four-bit registers, one for each viewport. The register for viewport #1 is labeled 77-1; the register for viewport #2 is labeled 77-2; etc. In operation, correlator 77 receives the number of a viewport on conductors 35; and in response thereto, it transfers the content of that viewport's register onto the conductors 76. Those four bits have one of sixteen binary states which select one of the sixteen color maps.

Additional address bits are also received by array 71 from the previously described pixel shifter 49. Recall that shifter 49 receives pixel words on bus 17 from image memory 14; and it shifts the individual pixels in those words one at a time onto conductors 18. Each of the pixels on the conductors 18 has six bits or sixty-four possible states; and they are used by array 71 to select one of the entries from all three sections in the color map which correlator 77 selected.

One other address bit is also received by array 71 on a conductor 78. This address bit is labeled "SO" in FIG. 6 which stands for "screen overlay". Bit "SO" comes from a parallel-serial shifter 79; and shifter 79 has its parallel inputs coupled via conductors 80 to a screen overlay memory 81.

Memory 81 contains one bit for each pixel on screen 16. Thus, in the embodiment where screen 16 is 20×15 blocks with each block being 32×32 pixels, memory 81 is also 20×15 blocks and each block contains 32×32 bits. One word of thirty-two bits in memory 18 is addressed by the combination of the previously described block counter 30 and line counter 50. They are coupled to address input terminals of memory 81 by conductors 31 and 51 respectively.

A bit pattern is stored in memory 81 which defines the position and shape of the overlay on screen 16. In particular, if the bit at one location in memory 81 is a logical "one", then the overlay pattern exists at that same location on screen 16; whereas if the bit is a "zero", then the overlay pattern does not exist at that location. Those "one" bits are arranged in memory 81 in any selectable pattern (such as a cursor that is shaped as an arrow or a star) and are positioned at any location in the memory.

Individual bits on conductor 78 are shifted in synchronization with the pixels on conductors 18 to the memory array 71. Then, if a particular bit on conductor 78 is a "zero", memory 71 selects the pair of colors in columns 72a and 72b of a color map; whereas if a particular bit on conductor 78 is a "one", then array 71 selects the pair of colors in columns 72c and 72d of a color map.

Still another address bit is received by array 71 on a conductor 82. This bit is a blink bit; and it is identified in FIG. 6 as BL. The blink bit is sent to conductor 82 by a blink register 83. Register 83 has respective bits for each of the viewports; and they are identified as bits 83-0 through 83-7.

Individual bits in blink register 83 are addressed by the viewport select signals on the conductors 35. Specifically, blink bit 83-1 is addressed if the viewport select signals identify viewport number one; blink bit 83-2 is addressed if the viewport select signals identify viewport number two; etc.

In array 71, the blink bit on conductor 82 is used to select one color from a pair in a particular entry of a color map. Suitably, the leftmost color of a pair is selected if the blink bit is a "zero"; and the rightmost color of a pair is selected if the blink bit is a "one". This is indicated by the Boolean expressions in color map section 72.

From the above description, it should be evident that each of the images that is displayed through its respective viewport has its own independent set of colors. This is because each viewport selects its own color map via the viewport-color map correlator 77. Thus, a single pixel in memory array 14 will be displayed on screen 16 as any one of several different colors depending upon which viewport that pixel is correlated to.

Figure 16:
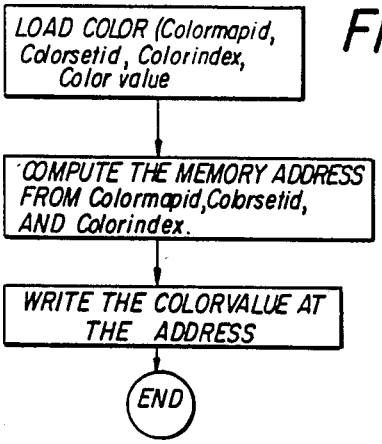
FIG. 16 is a flow chart illustrating the Load Color Command.

A set of colors is loaded into memory array 71 by entering a LOAD COLOR MEMORY command (FIG. 16) via keyboard 10. Also, a color map ID and color section ID are entered along with the desired color bit pattern. That data is then sent over bus 13 to buffer 52 whereupon the color bit pattern is written into the identified color map section by means of control signals CTL7 from control register 40. This occurs during a screen retrace time.

Figure 17:
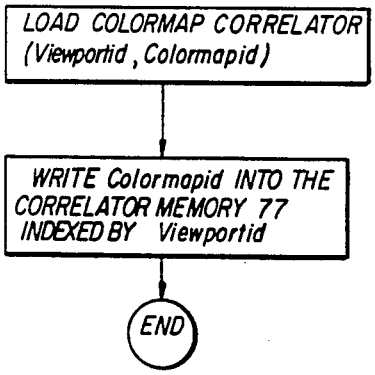
FIG. 17 is a flow chart illustrating the Load Colormap Correlator Command.

Likewise, any desired bit pattern can be loaded into correlator 77 by entering a LOAD COLOR MAP CORRELATOR command (FIG. 17) via keyboard 10 along with a register identification number and the desired bit pattern. That data is then sent over bus 13 to buffer 52; whereupon the desired bit pattern is written into the identified register by means of control signals CTL8 from control register 40.

Further from the above, it should be evident that each of the viewports on screen 16 can blink at its own independent frequency and duty cycle. This is because each viewport has its own blink bit in blink register 83; and the pair of colors in a color map entry are displayed at the same frequency and duty cycle as the viewport's blink bit.

Figure 18:
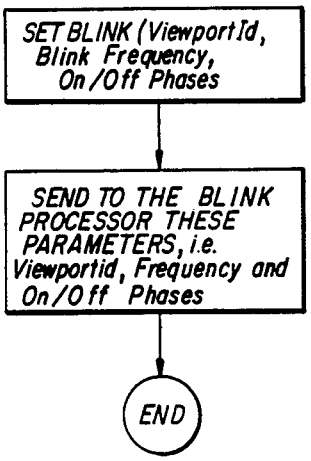
FIG. 18 is a flow chart illustrating the Set Blink Command.

Preferably, a microprocessor 84 is included in the FIG. 6 embodiment to change the state of the individual bits in register 83 at respective frequency and duty cycles. In operation, a SET BLINK command (FIG. 18) is entered via keyboard 10 along with the ID of one particular blink bit in register 83. Also, the desired frequency and duty cycle of that blink bit is entered. By duty cycle is meant the ratio of the time interval that a blink bit is a "one" to a time interval equal to the reciprocal of the frequency.

That data is sent over bus 13 to buffer 52; whereupon it is transferred on conductors 53 to microprocessor 84 in response to control signals CTL9. Microprocessor 84 then sets up an internal timer which interrupts the processor each time the blink bit is to change. Then microprocessor 84 sends control signals CS on a conductor 85 which causes the specified blink bit to change state.

Further from the above description, it should be evident that the FIG. 6 embodiment provides a cursor that moves independent of the viewport boundaries and has an arbitrarily defined shape. This is because in memory 81, the "one" bits can be stored in any pattern and at any position.

Figure 19:
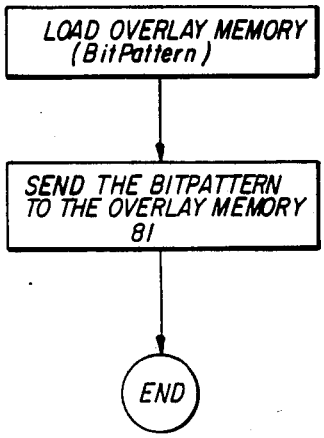
FIG. 19 is a flow chart illustrating the Load Overlay Memory Command.

Those "one" bits are stored in response to a LOAD OVERLAY MEMORY command (FIG. 19) which is entered via keyboard 10 along with the desired bit pattern. That data is then sent over bus 13 to buffer 52; whereupon the bit pattern is transferred into memory 81 during a screen retrace time by means of control signals CTL10 from control register 40.

Suitably, each of the above described components is constructed of high speed Schottky $T^2L$ logic. For example, components 71, 74, 77, 79, 81, and 83 can respectively be 1420, HDG0605, 74219A, 74166, 4864, and 74373 chips.

Various preferred embodiments of the invention have now been described in detail. In addition, however, many changes and modifications can be made to these details without departing from the nature and spirit of the invention.

For example, the total number of viewports can be increased or decreased. Similarly, the number of blocks per frame, the number of lines per block, the number of pixels per word, and the number of bits per pixel can all be increased or decreased. Further, additional commands or transducers, such as a "mouse", can be utilized to initially form the images in the image memory 14.

Accordingly, since many such modifications can be readily made to the above described specific embodiments, it is to be understood that this invention is not limited to said details but is defined by the appended claims.

What is claimed is:

1. A method of electronically displaying and moving portions of several different images on a screen; including the steps of:

storing control signals in a first memory which partition said screen into an array of blocks and define several overlapping prioritized viewports on said screen by specifying which of said blocks are included in each viewport;

correlating each viewport to a portion of a respective one of said images by associating a set of parameters IW, TOPX, TOPY, Xmin, Ymin and N with each viewport where IW defines a width in blocks of said viewport, BA defines a base address for said image which is correlated to said viewport, TOPX and TOPY define a position of said viewport relative to said image which said viewport is correlated to, Xmin and Ymin define a position of said viewport on said screen, and N defines a number of lines within each block;

storing in a second memory, a respective set of two numbers IW and BA+(TOPY)(IW)(N)+TOPX−Xmin−(Ymin)(IW)(N) for each viewport;

determining, from said signals in said first memory, which of said viewports in a particular block has a priority that is higher than that of any other viewport in said particular block;

forming, from said numbers in said second memory, an address for several adjacent pixels in one line of said image that is correlated to said viewport as determined by said determining step;

reading said adjacent pixels at the address formed by said forming step and transferring those same pixels to said screen for display;

repeating the determining, forming and reading steps for all of said lines in all of the blocks in said array.

2. A method according to claim 1 and further including the steps of storing said control signals and numbers in a predetermined order in said first and second memories and moving said images on said screen by changing just said order in which said control signals and numbers are stored.

3. A method according to claim 1 and further including the step of changing said images that are displayed via said viewports by changing just said numbers that are stored in said second memory.

4. A method according to claim 1 and further including the step of moving said images on said screen by shifting in an end-around fashion just said control signals in said first memory.

5. A method according to claim 1 and further including the step of adding said two numbers of said set together each time a new line is displayed on said screen.

6. A method according to claim 1 wherein said determining and forming steps are preformed for one block in said array, and simultaneously said reading step is performed for another block in said array.

7. A method of electronically displaying and moving portions of several different images on a screen; including the steps of:

storing control signals in a predetermined order in a first memory to partition said screen into an array of blocks and define several overlapping prioritized viewports on said screen by specifying which of said blocks are included in each viewport;

correlating each viewport to a portion of a respective one of said images by storing in a predetermined order in a second memory, a respective set of two numbers for each viewport;

determining, from said signals in said first memory, which of said viewports in a particular block has a priority that is higher than that of any other viewport in said particular block;

forming, from said numbers in said second memory, an address for several adjacent pixels in said image that is correlated to said viewport as determined by said determining step;

reading said adjacent pixels at the address formed by said forming step and transferring those same pixels to said screen for display;

repeating the determining, forming and reading steps for all of said lines in all of the blocks in said array; and moving said images on said screen by changing just said predetermined order in which said control signals and numbers are respectively stored in said first and second memories.

8. A method according to claim 7 and further including the steps of associating a set of parameters IW, TOPX, TOPY, Xmin, Ymin and N with each viewport where IW defines a width in blocks of said viewport, BA defines a base address for said image which is correlated to said viewport, TOPX and TOPY define a position of said viewport relative to said image which said viewport is correlated to, Xmin and Ymin define a position of said viewport on said screen, and N defines a number of lines within each block; and storing in said second memory, IW and BA+(TOPY)(IW)(N)+TOPX−Xmin−(Ymin)(IW)(N) for each viewport as said respective set of two numbers.

9. A method of electronically displaying and moving portions of several different images on a screen; including the steps of:

storing control signals in a predetermined order in a first memory to partition said screen into an array of blocks and define several overlapping prioritized viewports on said screen by specifying which of said blocks are included in each viewport;

correlating each viewport to a portion of a respective one of said images by storing in a predetermined order in a second memory, a respective set of two numbers for each viewport;

determining, from said signals in said first memory, which of said viewports in a particular block has a priority that is higher than that of any other viewport in said particular block;

forming, from said numbers in said second memory, an address for several adjacent pixels in said image that is correlated to said viewport as determined by said determining step;

reading said adjacent pixels at the address formed by said forming step and transferring those same pixels to said screen for display;

repeating the determining, forming and reading steps for all of said lines in all of the blocks in said array; and changing said images that are displayed via said viewports by changing just said numbers that are stored in said second memory.

10. A method according to claim 9 and further including the steps of associating a set of parameters IW, TOPX, TOPY, Xmin, Ymin and N with each viewport where IW defines a width in blocks of said viewport, BA defines a base address for said image which is correlated to said viewport, TOPX and TOPY define a position of said viewport relative to said image which said viewport is correlated to, Xmin and Ymin define a position of said viewport on said screen, and N defines a number of lines within each block; and storing in said second memory, IW and BA+(TOPY)(IW)(N)+TOPX−Xmin−(Ymin)(IW)(N) for each viewport as said respective set of two numbers.

* * * * *